US006945408B2

(12) United States Patent
Niitti

(10) Patent No.: US 6,945,408 B2
(45) Date of Patent: Sep. 20, 2005

(54) FLOTATION MACHINE

(75) Inventor: Timo Niitti, Espoo (FI)

(73) Assignee: Outokumpu Technology Oy, Espoo (FI)

( * ) Notice: Subject to any disclaimer, the term of this patent is extended or adjusted under 35 U.S.C. 154(b) by 0 days.

(21) Appl. No.: 10/473,781

(22) PCT Filed: Apr. 3, 2002

(86) PCT No.: PCT/FI02/00282

§ 371 (c)(1),
(2), (4) Date: Oct. 1, 2003

(87) PCT Pub. No.: WO02/081093

PCT Pub. Date: Oct. 17, 2002

(65) Prior Publication Data

US 2004/0112799 A1 Jun. 17, 2004

(30) Foreign Application Priority Data

Apr. 4, 2001 (FI) ..... 20010701

(51) Int. Cl.[7] ..... B03D 1/16
(52) U.S. Cl. ..... 209/169; 261/87
(58) Field of Search ..... 209/169; 261/87

(56) References Cited

U.S. PATENT DOCUMENTS 3,485,484 A * 12/1969 Quinchon ..... 261/87
4,078,026 A * 3/1978 Fallenius ..... 261/87
4,800,017 A * 1/1989 Krishnaswamy et al. ... 210/219

FOREIGN PATENT DOCUMENTS

| | | | | |
|---|---|---|---|---|
| DE | 3635642 C2 | | 4/1988 | ..... B03D/1/16 |
| FR | 1361052 A | | 6/1963 | |
| SE | 323040 B | | 4/1970 | ..... B03D/1/16 |
| WO | 97/06892 | * | 2/1997 | |

* cited by examiner

*Primary Examiner*—Thomas M. Lithgow
(74) *Attorney, Agent, or Firm*—Morgan & Finnegan, L.L.P.

(57) ABSTRACT

The invention relates to a flotation machine, particularly to a flotation machine rotor, that is used for dispersing air, supplied via the rotor axis, to the surrounding slurry, and in which rotor there are formed alternating air ducts and slurry grooves, so that the ends of both the air ducts and the slurry grooves, projecting outwardly from the rotor, form the outer surface of the rotor According to the invention the air ducts (3,15) are arranged in the rotor at essentially equal distances, starting radially from the rotor outer surface, so that the air ducts (3,15) form in the center part of the rotor a space (6,17) for the slurry, in which space the slurry surrounding the rotor is to be made to flow along the slurry grooves (5, 16) provided in between the air ducts (3,15).

13 Claims, 3 Drawing Sheets

A – A

FLOTATION MACHINE

Figure 1:
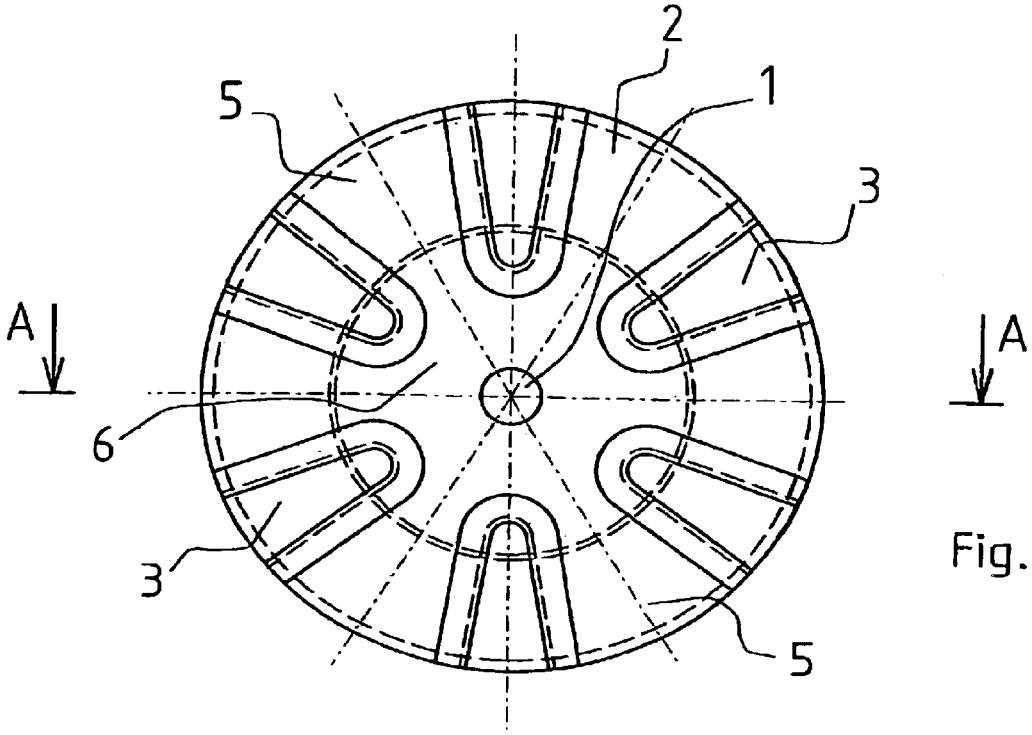

The present invention relates to a flotation machine that is used for separating valuable ingredients contained in a slurry, such as metal concentrates, from the rest of the material. In particular, the invention relates to a rotor used in a flotation machine, which rotor, when rotated, sets in motion the slurry fed into the flotation cell of the flotation machine, and simultaneously air is fed into the slurry by means of the rotor in order to set the slurry in suspension.

A flotation machine used for recovering valuable ingredients, such as metal concentrates, usually comprises a flotation cell provided with an inlet aperture for feeding slurry into the cell, and an outlet aperture for letting the non-flotated material out of the cell. The air needed for creating the foam is fed through a hollow rotatable axis, which axis is connected to an agitating member that mixes the slurry in order to maintain said slurry in suspension. When the agitator rotates, air is fed into the slurry, and air bubbles are dispersed therein. In addition, into the flotation cell there are fed reagents that are attached on the surface of the valuable particles that should be recovered from the slurry. Said reagents make the valuable particles hydrophobic and thus help them attach to the air bubbles. When the valuable particles are attached to the air bubbles, they start to rise up towards the free top surface of the flotation cell, where they form a stabile foam bed. In so-called reversed flotation, the valueless ingredients are made hydrophobic, in which case the valuable material remains non-flotated in the flotation process.

In order to render the slurry contained in the flotation cell into suspension, there can be employed for instance a rotor-stator combination described in the U.S. Pat. No. 4,078,026, where air is fed through the hollow axis used for rotating the rotor, and where the stator that is provided around the rotor guides the circulation of the suspension formed by the slurry and air. Air is fed to the slurry via air ducts made in the rotor. The air ducts are designed so that they start directly from the center part of the rotor. In addition, the rotor is provided with slurry grooves, by means of which the slurry is set in rotary motion advantageous for the creation of the suspension. In the rotor according to the U.S. Pat. No. 4,078,026, the air ducts are formed of narrow apertures or grooves outlined by parallel walls, in which case the feeding of air is directed to an essentially narrow sector. This type of air supply makes the dispersion of air into the slurry more difficult, because it enlarges the bubble size and thus increases the amount of air required in the flotation process.

The object of the invention is to alleviate the drawbacks of the prior art and to realize an advanced flotation machine for separating valuable ingredients, such as metal concentrates, from the rest of the material, said flotation machine being provided with a rotor by means of which air can be dispersed into the surrounding slurry more efficiently than before in order to improve the flotation of valuable ingredients. The essential novel features of the invention are enlisted in the appended claims.

When separating valuable ingredients from the rest of the material by means of flotating in a flotation machine according to the invention, the slurry fed into the flotation cell of the flotation machine is set to motion by means of a rotor arranged at the tip of a hollow axis. The rotor is provided with alternating air ducts and slurry grooves, so that the outer surface of the rotor is formed by the ends of said air ducts and slurry grooves projected outwardly of the rotor. The outer surface of the rotor is designed so that the diameter of the outer surface is decreased in relation to the rotor axis when proceeding further away from the axis. In the rotor, the air ducts are installed in the rotor at essentially equal distances, radially from the rotor outer surface, so that the air ducts form in the center part of the rotor a space for the slurry, in which space the slurry is to be made to flow freely along the slurry grooves provided in between the air ducts. In addition, the air duct walls are mutually divergent and separated in the direction proceeding outwardly from the center part of the rotor. Thus the air coming out through the air ducts meets the slurry surrounding the rotor in an area that is larger than in the prior art, in which case air is dispersed more efficiently in the surrounding slurry.

In the flotation machine according to the invention, the rotor air ducts meant for dispersing air into the surrounding slurry are supported by means of a lid element arranged in the top part of the rotor. The lid element is further attached around the rotor axis, advantageously in circular form. Moreover, the air ducts are connected to each other by means of said lid element arranged in the top part of the rotor. The lid element is advantageously provided with channels via which the air supplied to the rotor through the hollow axis is to be made to flow from the center part of the rotor to the air ducts thereof. The channels leading from the center part of the rotor to the air ducts can also be realized so that underneath the rotor lid element, there is installed an air channel system that is advantageously attached to the lid element but separate from said lid element. At least one of the channels provided for air circulation can also be provided with at least one aperture arranged in the center part of the rotor or in the immediate vicinity of the center part, so that when flowing through said aperture, air is conducted to the space designed for the slurry which is provided in the center part of the rotor. Thus air can be made to disperse also in this area.

According to the invention, the air ducts of the flotation machine according to the invention are installed in the rotor at essentially equal distances from each other, in a radial fashion starting from the outer surface of the rotor, so that the length of the air ducts is 40–60% of the radius of the lid element provided in the top part of the rotor. The air duct walls are mutually divergent, and they are advantageously directed towards the center of the rotor axis, so that the wall extensions intersect at the center point of the rotor axis. Thus the air duct walls form an angle of 15–30 degrees. In addition, the air ducts are designed so that the air duct discharge surface with respect to the slurry extends as essentially uniform along the whole height of the rotor, from the lid element to the bottom part. Thus air can be fed through the air ducts to the slurry that is set in a radial motion in the slurry groove of the rotor, essentially along the whole height of the rotor.

The slurry grooves provided in the rotor of the flotation machine according to the invention essentially fill the remaining rotor volume that is left after the rotor air ducts and the air ducts provided in the lid element or in the vicinity of said lid element. Thus the slurry surrounding the rotor can flow through the apertures left between the air ducts directly to the center part of the rotor, or from the center part to the outer surface of the rotor, in which case the slurry in the rotor may proceed in the radial direction of the rotor for the length of the whole radial distance, which means that the efficiency in the agitation is improved. The essentially free slurry circulation in the radial direction to the center of the rotor or away from the center as such improves the mixing of the slurry surrounding the rotor and thus reduces the power required for agitating the slurry.

Figure 2:
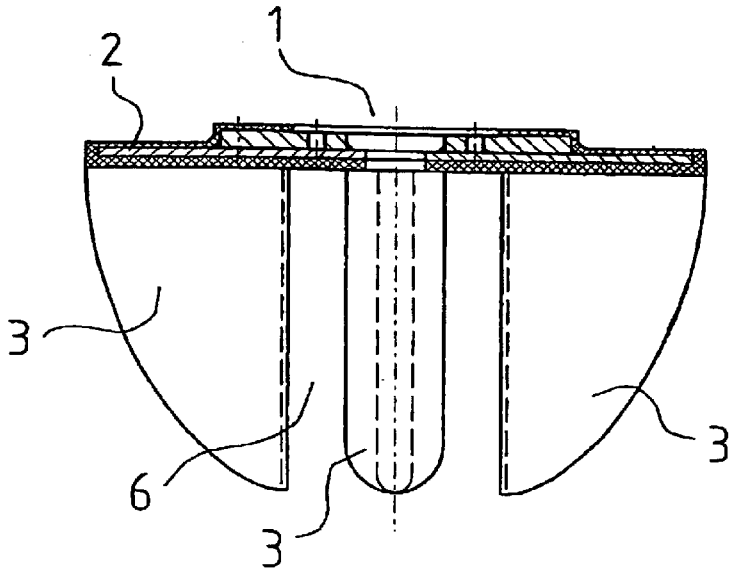
Figure 3:
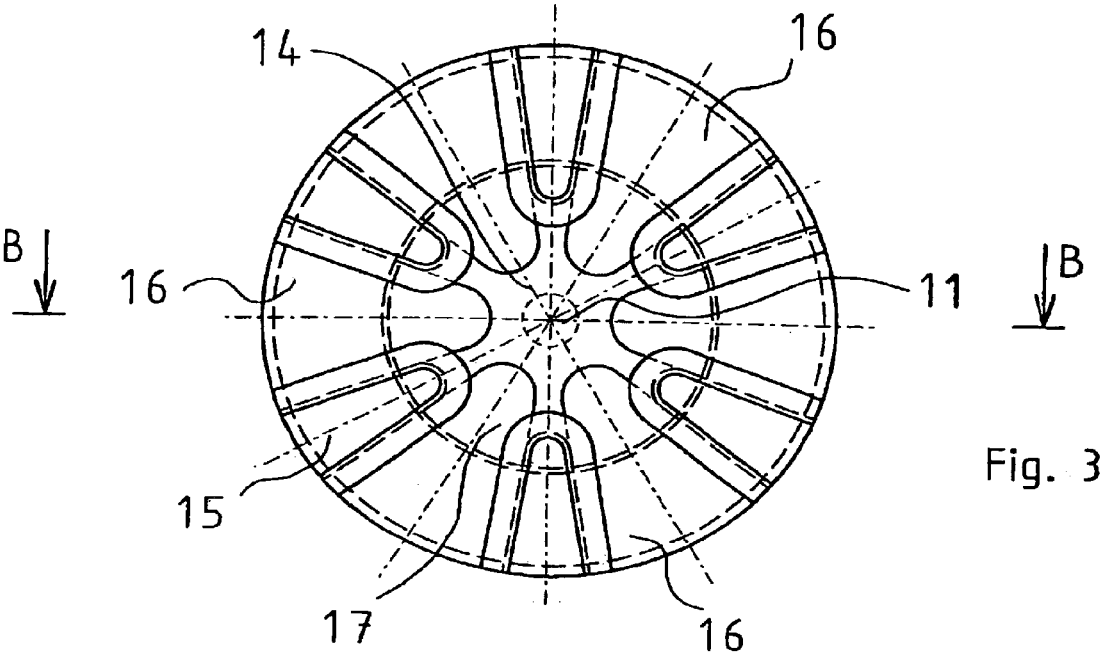
Figure 4:
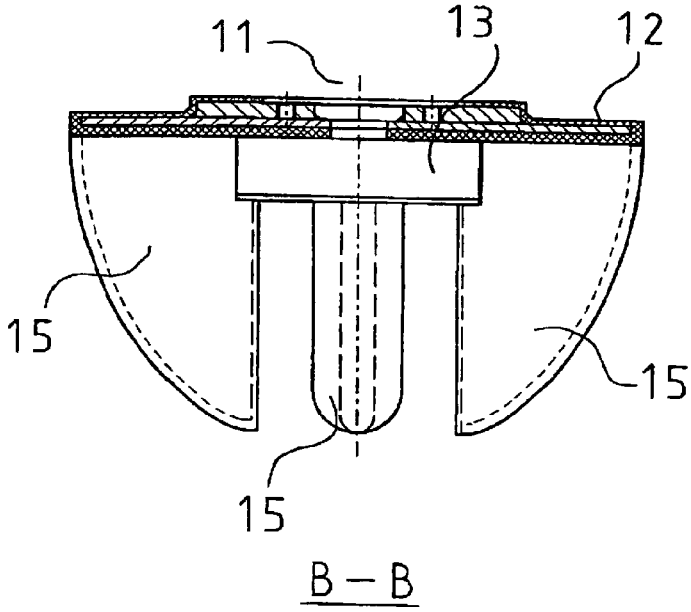
Figure 5:
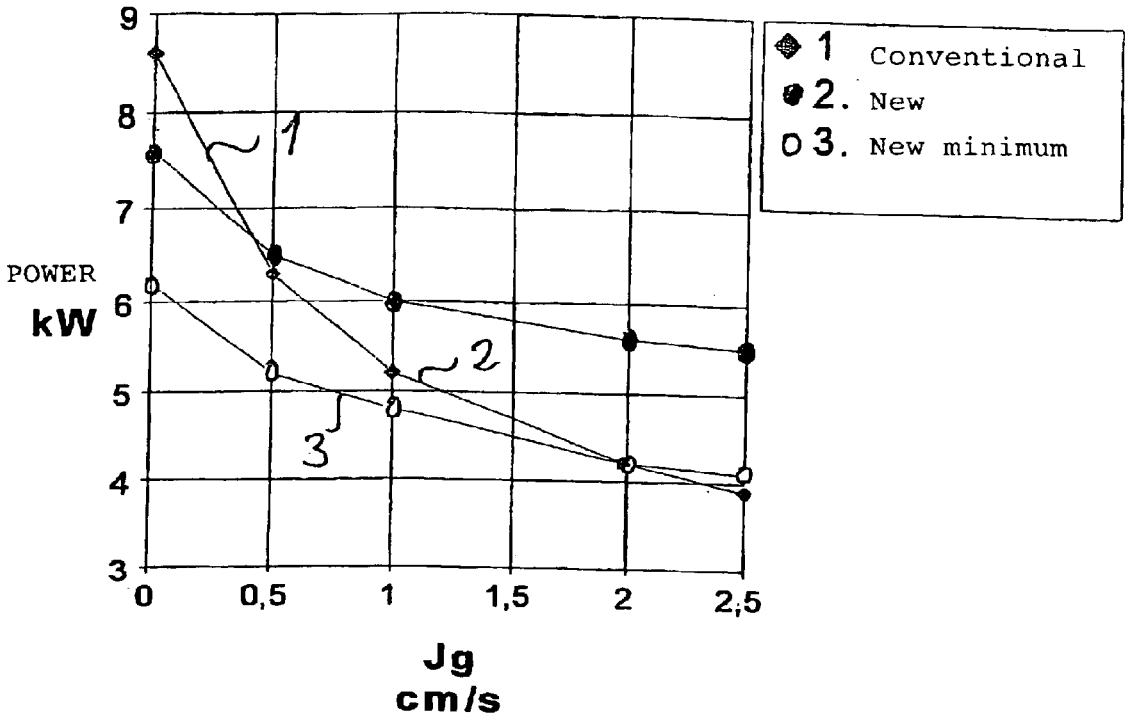

The invention is described in more detail below with reference the appended drawings, where FIG. 1 is a schematical illustration of a preferred embodiment of the invention, seen from below, FIG. 2 is a schematical illustration of the embodiment of FIG. 1, seen from the direction 2—2, FIG. 3 is a schematical illustration of another preferred embodiment of the invention, seen from below, FIG. 4 is a schematical illustration of the embodiment of FIG. 3, seen from the direction 4—4, and FIG. 5 illustrates test results in air quantity—agitation power coordinates when comparing a conventional rotor with the rotor according to the present invention.

According to FIGS. 1 and 2, around the axis 1 of the flotation machine, there is arranged an essentially circular lid element 2. In the lid element 2, there are further attached the rotor air ducts 3 which extend, starting from the outer edge of the lid element 2, radially towards the rotor axis 1 along a length that forms about 50% of the length of the radius of the lid element 2. The opposite walls of the air duct 3 are directed towards the center part of the rotor axis 1, so that the walls together form an angle of 20 degrees. Inside the lid element 2, there are also formed channels 4 in order to conduct the air that is supplied via the rotor axis 1 to proceed into the air ducts 3. The elements that are left between the air ducts 3 form the slurry grooves 5 of the rotor. The slurry grooves 5 are interconnected by a space 6 that is provided for the slurry in the center part of the rotor.

In the embodiment of FIGS. 3 and 4, in the lid element 12 that is arranged around the rotor axis 11, there is attached a control element 13 for the air supplied to the rotor through the axis 11. The air control element 13 is provided with channels 14 for conducting air and for distributing it from the rotor axis 11 to the air ducts 15. Otherwise the air ducts 15 as such correspond, both in structure and in shape, essentially to the embodiment illustrated in FIGS. 1 and 2. The spaces left between the air ducts 15 form the rotor slurry grooves 16, through which the slurry surrounding the rotor is carried to the space 17 left between the rotor air ducts 15 and the rotor axis 1 1 and further out thereof.

In FIG. 5, the rotor of a flotation machine according to the invention is compared with the rotor of a conventional flotation machine. From FIG. 5 it is observed that without air, the agitation efficiency and power intake with a prior art rotor is 10–20% higher than with the rotor of the present invention. When air is fed into the area required by a normal flotation process (air quantity Jg 1.0–2.0 cm/s), the ratio is inverted, so that the rotor according to the invention agitates 20–30% more efficiently than the mechanism according to the prior art. In a practical application this means that when using the rotor according to the invention, the flotation machine can be provided with a motor that is 10–20% smaller, and still the agitation efficiency in the normal area of usage increases by 20–30%. Another possibility is that if the agitation efficiency of a prior art rotor is sufficient, and additional agitation does not bring forth any further advantages, the flotation machine according to the invention can be provided with a motor that is even 30–40% smaller than in the prior art arrangements.

What is claimed is:

1. A flotation machine used for dispersing air, supplied via a rotor axis, to a surrounding slurry, the flotation machine comprising:

a rotor secured to the rotor axis, the rotor having a plurality of substantially equally angularly spaced wall elements, each wall element having a pair of substantially flat, radially oriented and mutually diverging side walls and an inner wall portion connecting each of the pair of flat side walls, each wall element forming outward facing air duct for dispersing air into a surrounding slurry, the plurality of wall elements together defining slurry grooves, and further defining a center volume, separate from the air ducts, for the passage of slurry around and through the rotor, both the air ducts and the slurry grooves forming an outer surface of the rotor.

2. A flotation machine according to claim 1, further comprising a lid element arranged in an uppermost portion of the rotor for supporting the wall elements.

3. A flotation machine according to claim 2, wherein the air ducts extend about 40–60% of the length of a radius of the circular lid element.

4. A flotation machine according to claim 1, wherein imaginary extensions of the wall elements intersect at a center part of the rotor axis.

5. A flotation machine according to claim 1, wherein side walls of each wall element are separated by an angle of 15–30 degrees.

6. A flotation machine according to claim 1, wherein a discharge surface of air from the air ducts, with respect to the slurry, is essentially uniform along a whole height of the rotor.

7. A flotation machine according to claim 2, further comprising channels within the rotor lid element, through which air supplied via the rotor axis can flow to the air ducts.

8. A flotation machine according to claim 2, further comprising a separate air channel system attached to a lower surface of the lid element, through which system air supplied via the rotor axis can flow to the air ducts.

9. A flotation machine according to claim 8, wherein at least one flow channel of the air channel system includes at least one aperture for conducting air to the center volume defined by the wall elements.

10. A flotation machine according to claim 1, wherein the length of the air ducts is 40–60% of the length of a radius of the rotor.

11. A flotation machine according to claim 2, wherein the wall elements forming the air ducts do not extend radially beyond the lid element.

12. A flotation machine according to claim 1, wherein the wall elements have an arcuate outer profile, the rotor decreasing in diameter toward a bottom end of the rotor.

13. A flotation machine according to claim 7, wherein at least one flow channel of the air channel system includes at least one aperture for conducting air to the center volume for slurry defined by the wall elements.

* * * * *